United States Patent [19]

Ehrmann et al.

[11] Patent Number: 4,538,564

[45] Date of Patent: Sep. 3, 1985

[54] IGNITION DEVICE FOR INTERNAL COMBUSTION ENGINES

[75] Inventors: Karl Ehrmann; Richard Gerber, both of Stuttgart, Fed. Rep. of Germany

[73] Assignee: Robert Bosch GmbH, Stuttgart, Fed. Rep. of Germany

[21] Appl. No.: 515,055

[22] PCT Filed: Nov. 20, 1982

[86] PCT No.: PCT/DE82/00220

§ 371 Date: Jun. 23, 1983

§ 102(e) Date: Jun. 23, 1983

[87] PCT Pub. No.: WO83/01981

PCT Pub. Date: Jun. 9, 1983

[30] Foreign Application Priority Data

Dec. 4, 1981 [DE] Fed. Rep. of Germany ..... 3148053

[51] Int. Cl.[3] ..... F02P 1/00

[52] U.S. Cl. ..... 123/146.5 A; 123/420; 200/19 DR

[58] Field of Search ..... 123/420, 146.5 A; 200/19 DR

[56] References Cited

U.S. PATENT DOCUMENTS

| | | | |
|---|---|---|---|
| 2,305,018 | 12/1942 | MacGillivray | 123/146.5 A |
| 2,820,858 | 1/1958 | Tompkins | 123/146.5 A |
| 3,139,081 | 6/1964 | Tyzack | 123/420 |
| 3,145,324 | 8/1964 | Race | 123/420 |
| 3,447,004 | 5/1969 | Falge | 123/146.5 A |
| 3,577,963 | 5/1971 | Bechmann | 123/420 |
| 3,600,530 | 8/1971 | Dusenberry | 123/146.5 A |
| 3,906,917 | 9/1975 | Lorti | 123/146.5 A |
| 4,315,493 | 2/1982 | Onishi et al. | 123/146.5 A |

FOREIGN PATENT DOCUMENTS

| | | | |
|---|---|---|---|
| 525168 | 9/1921 | France | 123/146.5 A |
| 2370873 | 9/1978 | France | 123/146.5 A |
| 52-43040 | 4/1977 | Japan | 123/420 |
| 55-64159 | 5/1980 | Japan | 123/420 |

*Primary Examiner*—Ronald B. Cox

*Attorney, Agent, or Firm*—Frishauf, Holtz, Goodman & Woodward

[57] ABSTRACT

An ignition distributor (10) for internal combustion engines having an electronic system for the adjustment of the instant of ignition has a high-voltage distributor (15–18) rotating in synchronism with the engine, the distributor rotor (17) of which is fixable in an infinitely variable manner by an angular amount on a plate (23) of the coupler sheath (20) of the centrifugal adjuster (19). In order to enable ignoring the tolerances of the cooperating parts, the functional position of the rotor electrode (18) is adjusted by means of an adjusting ring (31). By means of the centrifugal adjuster (19), the distributor rotor (17) is coordinated with the electronically generated ignition timing and a small diameter of the ignition distributor (10) is thereby made attainable.

6 Claims, 3 Drawing Figures

IGNITION DEVICE FOR INTERNAL COMBUSTION ENGINES

STATE OF THE ART

In known ignition devices, the adjustment of ignition timing is attained via centrifugal and vacuum devices of the ignition distributor. At the same time, the distributor rotor is adjusted by the centrifugal adjuster; that is, over the entire engine speed range the rotor has the same position relative to the cap electrode. The diameter of the high-voltage distributor can therefore be relatively small. Furthermore, the rotor electrode and the cap electrodes of the high-voltage distributor must be dimensioned such that a sparkover of the ignition spark occurs reliably at all the prespecified ignition adjustment angles, yet at the same time a sparkover to an incorrect electrode (an incorrect cylinder) is precluded.

In fully electronic ignition timing adjustment, this is accomplished electronically, and the ignition triggering means must therefore be separate from the centrifugal adjuster. As a result of this necessary separation of the centrifugal adjuster from the triggering means, however, it is attained that the follow-up is no longer effective; this necessitates an increase in the diameter of the high-voltage distributor. A high-voltage distributor of larger diameter causes problems, however, because the necessary access to the individual assemblies in the engine area is already problematical, given the usually cramped conditions there.

ADVANTAGES OF THE INVENTION

The problem discussed in the above section is solved with the ignition device for internal combustion engines according to the invention. The concept on which the invention is based is the coordinated adjustment of the distributor rotor in accordance with the electronically generated ignition timing.

Advantageous further developments of the invention are described in the dependent claims. With the further features of the ignition device of a plate secured to a coupler sheath, and an adjustable connection between rotor and plate an adjustment of the distributor rotor is possible. If the device a ring with members which engage the housing and the outer rotor electrode and in particular with claim 6, then as a result all the tolerances of the cooperating parts, except for the adjusting tolerance, can be ignored. As a result, greater high-voltage strength is attained in the high-voltage distributor.

DRAWING

One exemplary embodiment of the invention is shown in the drawing and explained in detail in the description below. Shown in actual size are:

FIG. 1, is a cutaway view, a vertical section taken through an ignition distributor;

FIG. 2, a top plan view on an adjusting ring and a distributor rotor; and

FIG. 3, in an enlarged detail view, a radial section taken along the line III—III of FIG. 2.

DESCRIPTION OF THE EXEMPLARY EMBODIMENT

Figure 1:
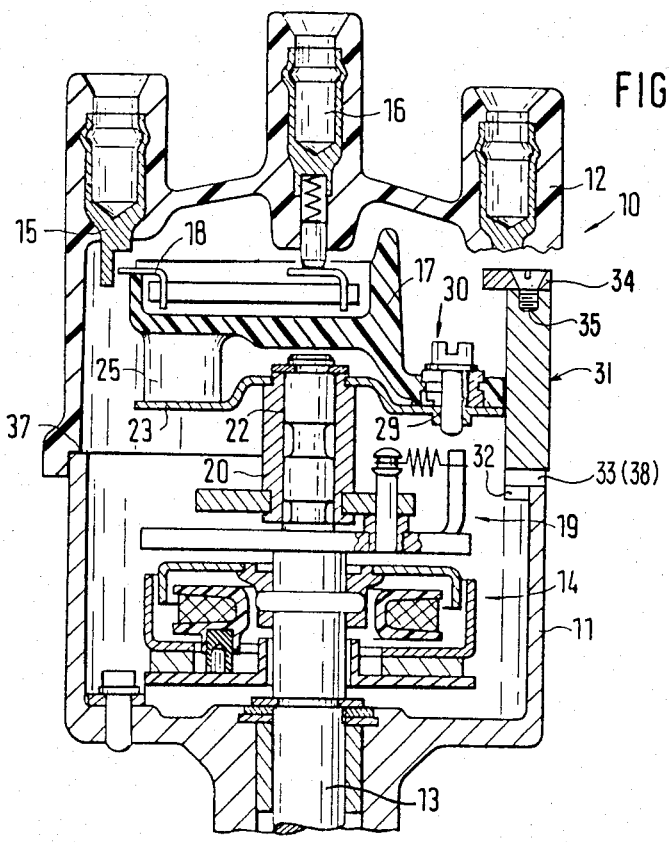
Figure 2:
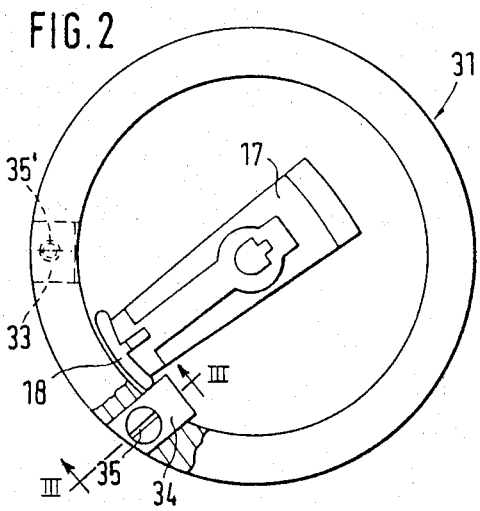
Figure 3:
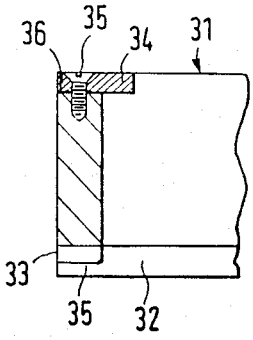

As part of an ignition device for internal combustion engines having an electronic system for adjusting the instant of ignition, FIG. 1 shows an ignition distributor 10 having a cup-shaped housing 11 secured on the engine block (not shown) and a cap 12 of insulating material. Supported in the housing 11 are a drive shaft 13 and an inductive transducer 14, which generates pulses and supplies them for processing to a network device (not shown). Molded in the cap 12 are fixed electrodes 15, corresponding in number to the number of engine cylinders, and a middle electrode 16.

A distributor rotor 17 supplies the high voltage of the middle electrode 16 via a rotor electrode 18 to the individual fixed electrodes 15 and to the spark plugs, not shown, connected therewith.

A centrifugal adjuster 19 is connected to the drive shaft 13 and coupled via a pair of springs 21 with a coupler sheath 20 supported on the end segment 22 of the drive shaft 13. A plate 23 having three internal threads 24 (only one of which is shown) is connected in an undetachable manner with the coupler sheath 20 by caulking.

The distributor rotor 17 has a plurality of protrusions 25 supported on the plate 23 and a plurality of flange segments 26, each having a molded sleeve 27. Each sleeve has an oblong slot 28, through which the threaded shank 29 of a cap screw 30 can be inserted, so that this cap screw can be threaded into and out of the internal thread 24 of the plate 23. The longitudinal extension of the oblong slot 28 is such that when the cap screw 30 is loosened, the distributor rotor 17 can be adjusted by several angular degrees relative to the drive shaft 13 and coaxially thereto in an infinitely variable manner, and the angular position established thereby can be fixed by means of the cap screw 30.

A sleevelike adjusting ring 31 of metal which can be placed, in lieu of cap 12, to adjust the rotor has on one end segment an internal groove 32 and a projection 33, which is secured by means of a sink screw 35'. The screw is offset from the adjusting ring 31 in the axial direction. The oppositely disposed portion of the adjusting ring 31 has a plate like recess 36, in which a protrusion 34, which points radially inward, is secured by means of a sink screw 35.

The adjusting ring 31 serves to adjust the rotor electrode 18 and to this end is seated on the rim 37 of the housing 11 in such a manner that the projection 33 engages a groove 38 of the rim 37. Subsequently the drive shaft 13 is brought into the triggering position (instant-of-ignition position) and the distributor rotor 17, released from the plate 23, is rotated until such time as its rotor electrode 18 comes to rest at the plate like protrusion 34. This functional position is fixed by means of the screw 30. As a result of this adjustment, none of the tolerances of the cooperating elements need to be taken into consideration.

We claim:

1. An ignition device, for internal combustion engines having an electronic system for the adjustment of both the ignition instant and the triggering of the ignition instant, and having a high-voltage distributor (10) rotating in synchrony with the internal combustion engine by means of a drive shaft (13), the high-voltage distributor (10) having a distributor rotor (17) with a rotor electrode (18) which supplies the ignition voltage via a respective fixed electrode (15) to at least one spark plug, and a cup-shaped housing (11) secured on the engine block, having a rim (37), and receiving the drive shaft, characterized by a centrifugal adjustor (19), the distributor rotor (17) and the drive shaft (13) being coupled via the centrifugal adjuster, which effects a follow-up adjustment of the distributor rotor with respect to the drive shaft (13), independently of the ignition triggering;

an adjusting ring (31) determining the relative angular position of said rotor (17) and said centrifugal adjuster (19), said ring being mountable on the rim (37) of the housing (11) in only one defined position (38) and having a protrusion (34) pointing into the interior of the housing (11), which protrusion serves as a stop for the adjustment of the rotor electrode (18);

and means (20, 23, 27, 28, 29, 30) for clamping the rotor (17) to the centrifugal adjustor (19) in an infinitely variable manner within an angular range.

2. An ignition device, as defined by claim 1, wherein the rim (37) of the housing (11) is formed with a groove (38), the adjusting ring (31) has a projection (33) engaging the groove (38), and the protrusion (34) on said ring (31) is angularly offset from the projection (33) by an angle such that, in the ignition-triggering position of the drive shaft (13), the rotor electrode (18) assumes its functional position by means of resting on the protrusion (34).

3. An ignition device as defined by claim 1, wherein the means for clamping the rotor (17) to the centrifugal adjustor (19) comprises a plate (23) coupled to the adjustor (19) and an infinitely variable positioning clamp (28, 29, 30) connecting the rotor to the plate (23).

4. A device as defined by claim 1 having a coupler sheath 20 of the centrifugal adjuster supported rotatably on the drive shaft (13), characterized in that the coupler sheath (20) has a plate (23), on which the distributor rotor (17) is secured.

5. A device as defined by claim 4, characterized in that the plate (23) is connected in an undetachable manner to the coupler sheath (20), and that the securing of the distributor rotor (17) on the plate (23) is effected in an infinitely variable manner within an angular range.

6. A device as defined by claim 5, characterized in that the adjustable securing of the distributor rotor (17) on the plate (23) is effected by means of at least one screws (30) and that a threaded shank (29) of each screw (30) can be passed through an oblong slot (28) of a sleeve (27) inserted in the distributor rotor (17) and cooperates with an internal thread (24) of the plate (23).

* * * * *